US006299332B1

(12) United States Patent
Huang

(10) Patent No.: US 6,299,332 B1
(45) Date of Patent: Oct. 9, 2001

(54) CHRISTMAS LAMP SHELL

(76) Inventor: Shun-Feng Huang, No. 13, Lane 84, Nei Hu Road, Hsin Chu City (TW)

( * ) Notice: Subject to any disclaimer, the term of this patent is extended or adjusted under 35 U.S.C. 154(b) by 0 days.

(21) Appl. No.: 09/598,026

(22) Filed: Jun. 21, 2000

(51) Int. Cl.[7] ..... F21V 3/00

(52) U.S. Cl. ..... 362/363; 362/235; 362/237; 362/239

(58) Field of Search ..... 362/235, 237, 362/249, 293, 806, 260, 360, 351, 391, 363, 219, 236, 310; D26/25; D11/117, 119

(56) References Cited

U.S. PATENT DOCUMENTS

D. 381,287 * 7/1997 Fussell ..... D11/121
D. 440,674 * 4/2001 Nichols ..... D26/25
2,863,041 * 12/1958 Steinbach .
4,234,915 * 11/1980 Malionwski et al. ..... 362/252
5,021,935 * 6/1991 Gary ..... 362/237
5,410,460 * 4/1995 Liou ..... 362/250
6,033,089 * 3/2000 Tesasuro ..... 362/249
6,059,430 * 5/2000 Chen ..... 362/353

* cited by examiner

*Primary Examiner*—Sandra O'Shea
*Assistant Examiner*—Jacob Choi
(74) *Attorney, Agent, or Firm*—Rosenberg, Klein & Lee

(57) ABSTRACT

Christmas lamp includes many lamp units. The lamp units each has an ornamental shell part and bulb. The ornamental shell parts are made to have various shapes, e.g. tree shapes, animal shapes, star shapes and spiral shell shapes. The bulbs are each received in a corresponding one of the ornamental shell parts with a lead passed through two end holes net for use. The shell parts having various colors and shapes can make the Christmas lamp look more attractive.

4 Claims, 8 Drawing Sheets

CHRISTMAS LAMP SHELL

BACKGROUND OF THE INVENTION

Christmas lamps play an important role in Christmas. Besides ornamental function, Christmas lamps add to the festive air in Christmas.

Referring to FIGS. 13 and 14, conventional Christmas lamps include leads and bulls. The bulls are connected together by the leads.

However, the conventional Christmas lamps have disadvantages as follows.

1. The bulls have monotonous shapes, and have only one function, i.e. giving out light.
2. Although the bulls are provided with various colors, the shapes of the bulls, both big-sized ones used outdoors and small-sized ones used indoors, have not been changed for many years.
3. The Christmas lamps are sometimes connected to nets of various shapes to become more attractive but the consumers no longer feel satisfied with this variety.

SUMMARY OF THE INVENTION

Therefore, it is a main object of the present invention to provide a Christmas lamp which have various shapes and colors.

The Christmas lamp includes many lamp units. Each of the lamp units has an ornamental shell part and a bulb. The ornamental shell parts have various shapes, e.g. tree shapes, animal shapes, star shapes and spiral shell shapes. The bulbs are each received in a corresponding one of the ornamental shell parts with a lead passed through two end holes of the ornamental shell parts.

The lamp units are connected to a line or net for use.

When the bulbs give out light, the ornamental shell parts can reflect light in various ways, making the Christmas lamp look attractive.

The ornamental shell parts can be made to have two half parts; the half parts have an annular groove and an annular protrusion on edges respectively such that the half parts can be combined by fitting the annular protrusion into the annular groove. The ornamental parts can be made to have only one single main body; the main body has a receiving hole at least wider than the bulb such that the bulb can be passed through the receiving hole. A cap member is fitted to the receiving hole to close the receiving hole.

BRIEF DESCRIPTION OF THE DRAWINGS

The present invention will be better understood by reference to the accompanying drawings, wherein.

DESCRIPTION OF THE PREFERRED EMBODIMENTS

Figure 2:
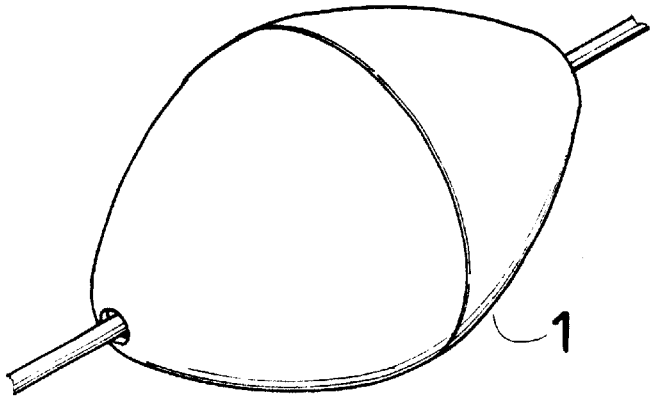
FIG. 2 is a perspective view of the lamp unit of the Christmas lamp of FIG. 1.
Figure 4:
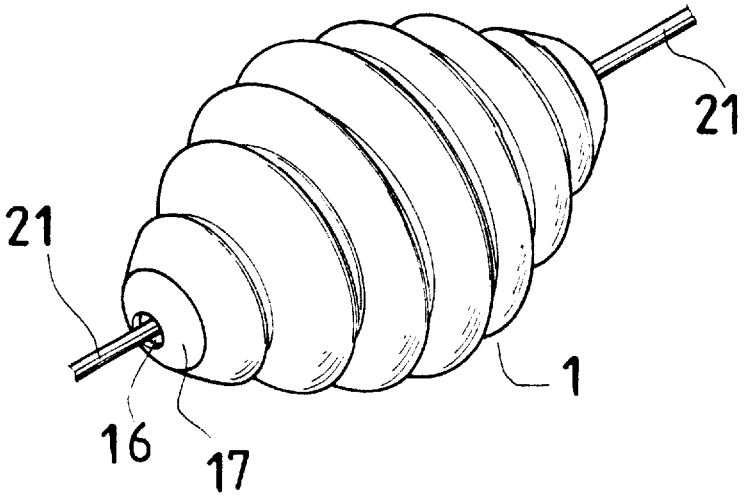
FIG. 4 is a perspective view the lamp unit in FIG. 3.
Figure 5:
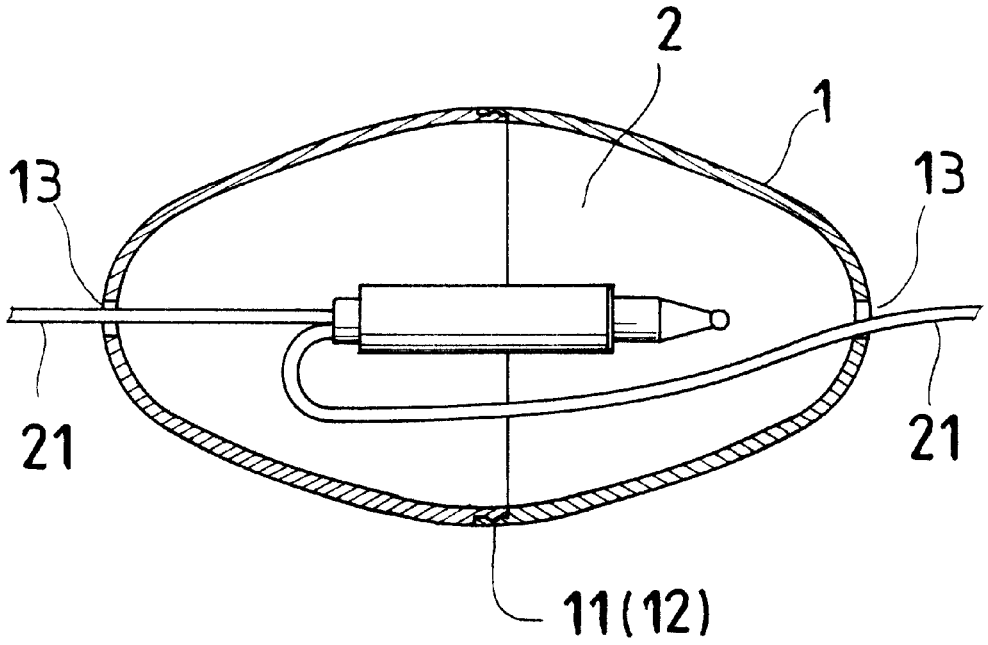
FIG. 5 is a cross-sectional view of an oval shape lamp unit of the present invention.
Figure 6:
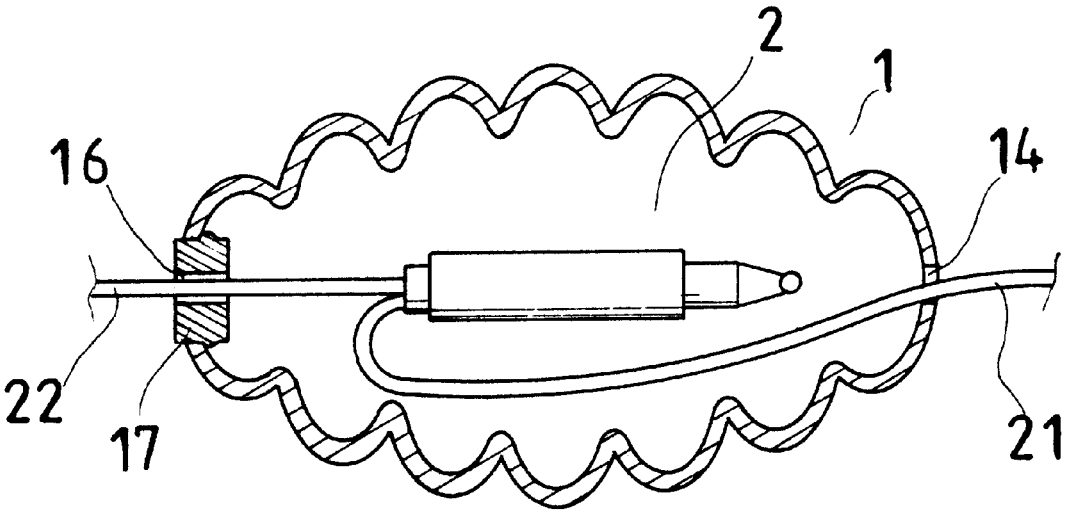
FIG. 6 is a cross-sectional view of a spiral shell shape lamp unit of the present invention.
Figure 7:
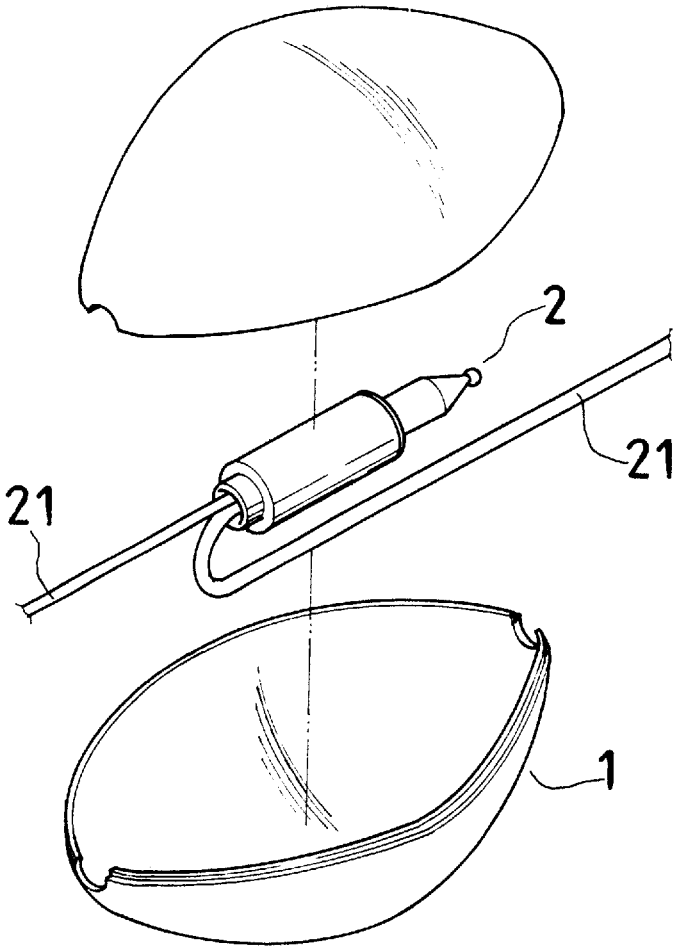
FIG. 7 is an exploded perspective view of a lamp unit according the third embodiment of the present invention.
Figure 8:
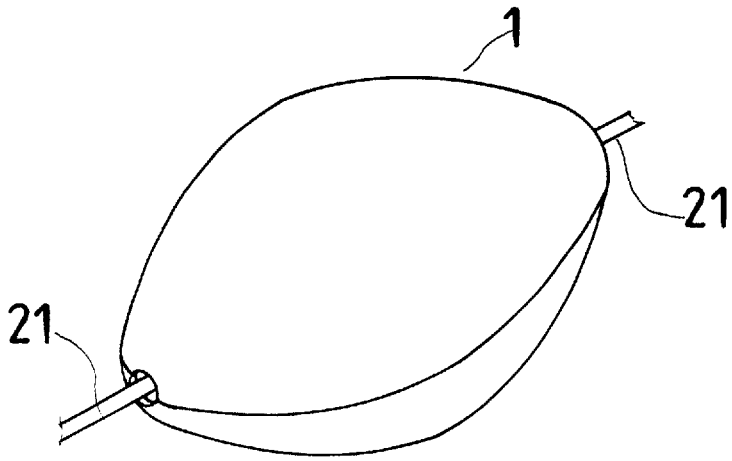
FIG. 8 is a perspective view the lamp unit in FIG. 7.
Figure 9:
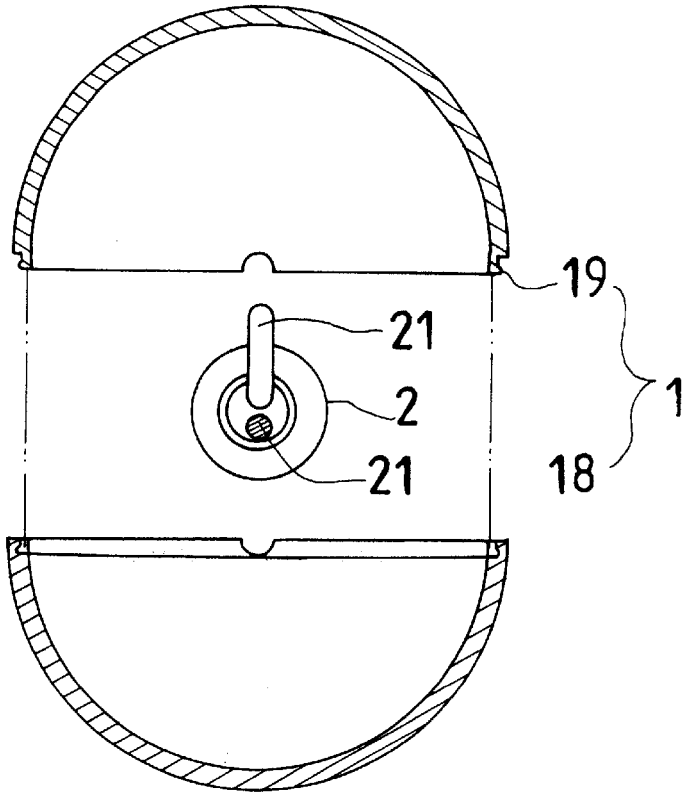
FIG. 9 is an exploded cross-sectional view of a round lamp unit according the fourth embodiment of the present invention.
Figure 10:
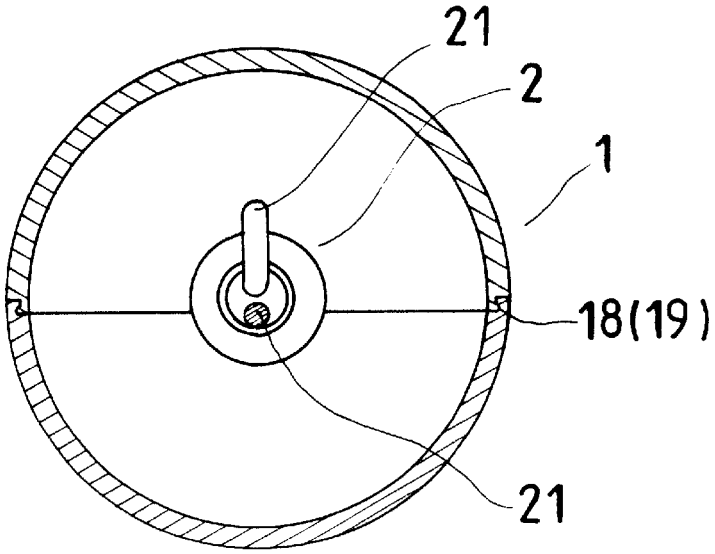
FIG. 10 is a cross-sectional view of the lamp unit in FIG. 9.
Figure 12:
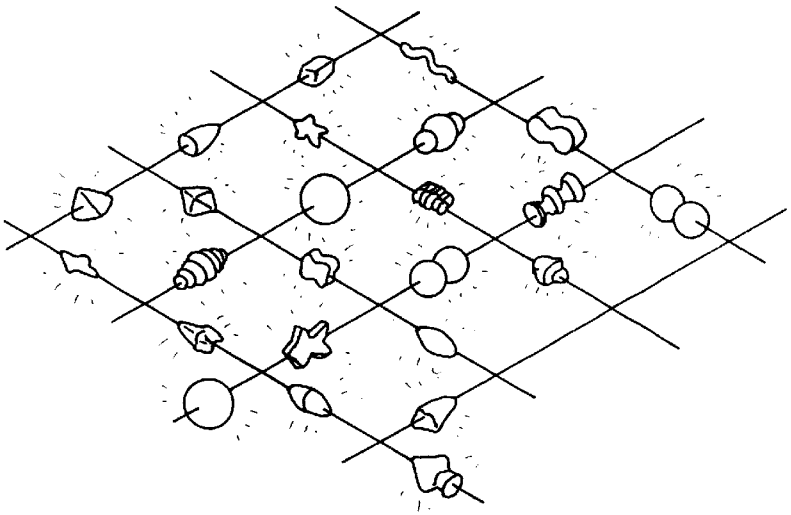
FIG. 12 is a view of another Christmas lamp of the present invention.

Referring to FIGS. 2, 4, and 12, Christmas lamp of the present invention consists of several lamp units of various shapes.

Figure 1:
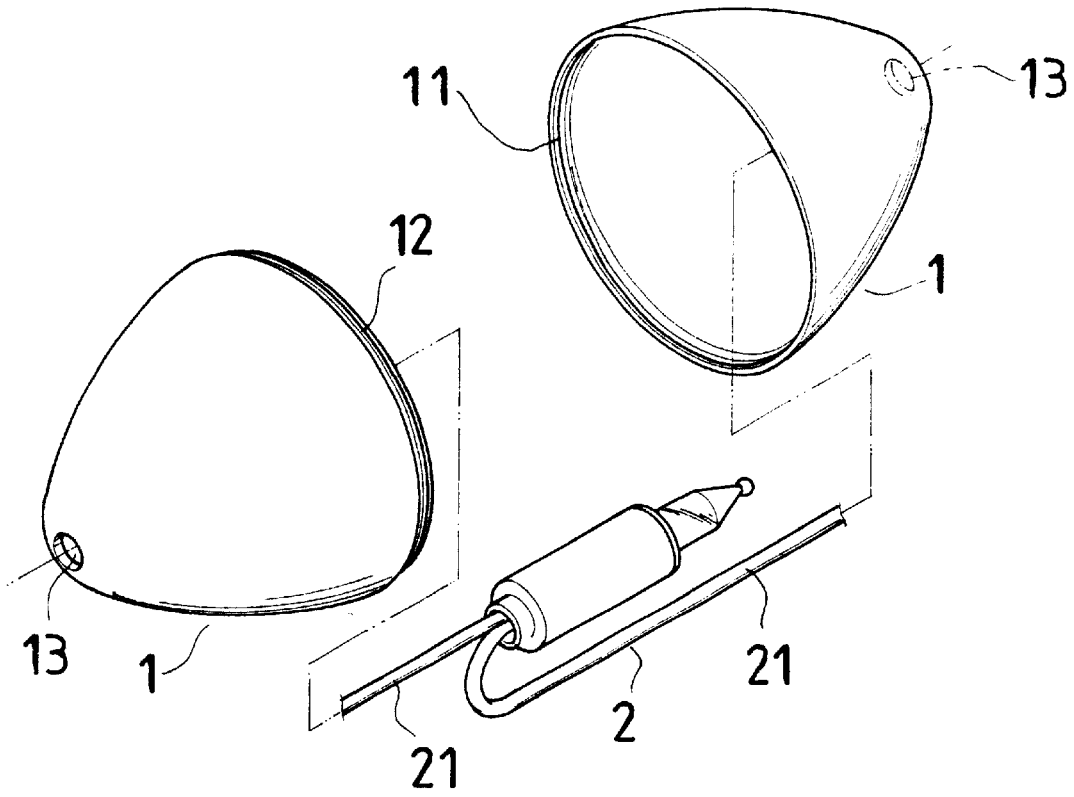
FIG. 1 is an exploded perspective view of a lamp unit of the Christmas lamp according to the first embodiment of the present invention.

Referring to FIG. 1, the lamp unit includes a bulb 2 and an ornamental shell part 1. The shell part includes a first half part and a second half part. Each of the half parts has a through hole 13. The first half part has an annular groove 11 on an edge thereof. The second half part has an annular protrusion 12 on an edge thereof. The bulb 2 is connected to a lead 21 such that the bulb 2 can give out light.

The first half part is combined with the second half part with the annular protrusion 12 engaging the annular groove 11; the bulb 2 is received in the combined half parts, i.e. the ornamental shell part 1 with the lead 21 passing through the through holes 13, 13 of the both half parts.

The ornamental shell parts are made to have tree shapes animal shapes, star shapes, spiral shell shapes, etc.

Figure 3:
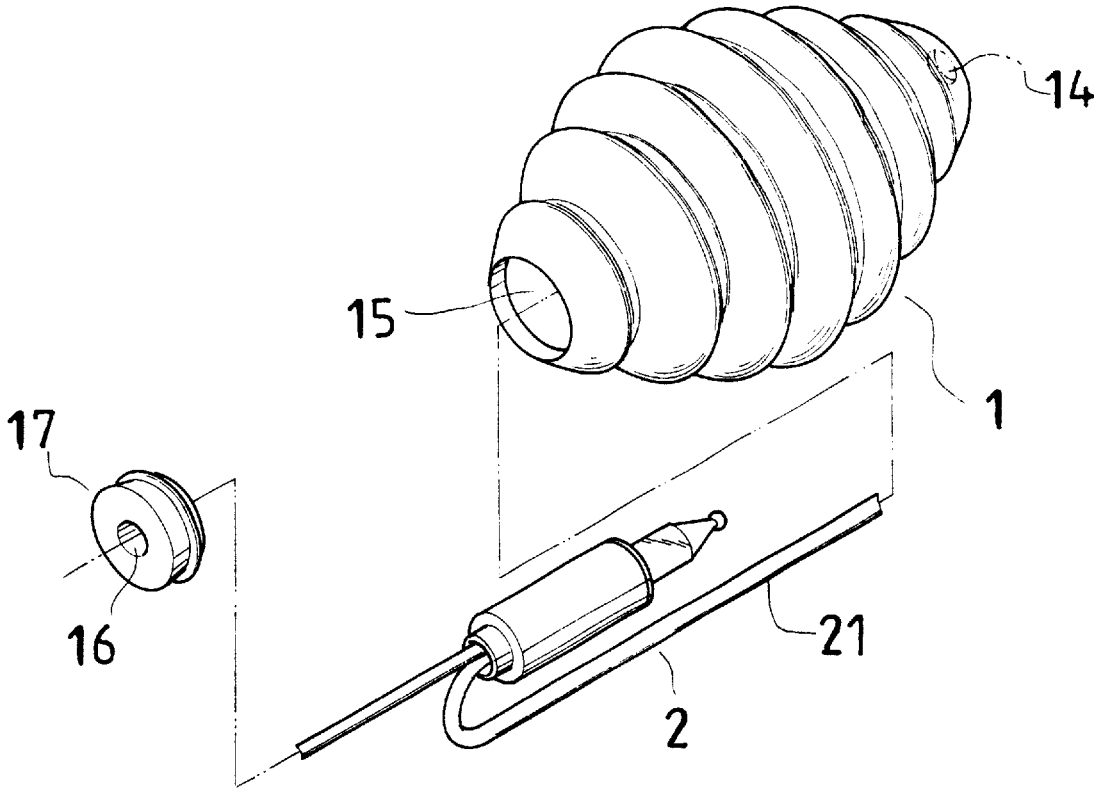
FIG. 3 is an exploded perspective view of a lamp unit according to the second embodiment of the present invention.

In a second embodiment of the present invention, referring to FIGS. 3, 4, the lamp unit has an ornamental shell part 1 and a bulb 2. The ornamental shell part I has a main body having a through hole 14 and a receiving hole 15, and has a cap member 17. The cap member 17 has a through hole 16. The receiving hole 15 is at least wider than the bulb 2 for permitting the bulb 2 to be passed therethrough. The cap member 17 can connect and close the receiving hole 15. The bulb 2 is received in the ornamental shell part 1 with a lead 21 thereof passing through the through hole 14 of the ornamental shell part 1 and the through holes 16 of the cap member 17.

The ornamental shell parts of various shapes of the present invention all can be made to have two half parts or only one single main body with a big receiving hole.

Referring to FIGS. 7–10, the an ornamental shell part 1 can be an upper and a lower half parts with annular groove 18 and annular protrusion 19 combined each other.

Figure 11:
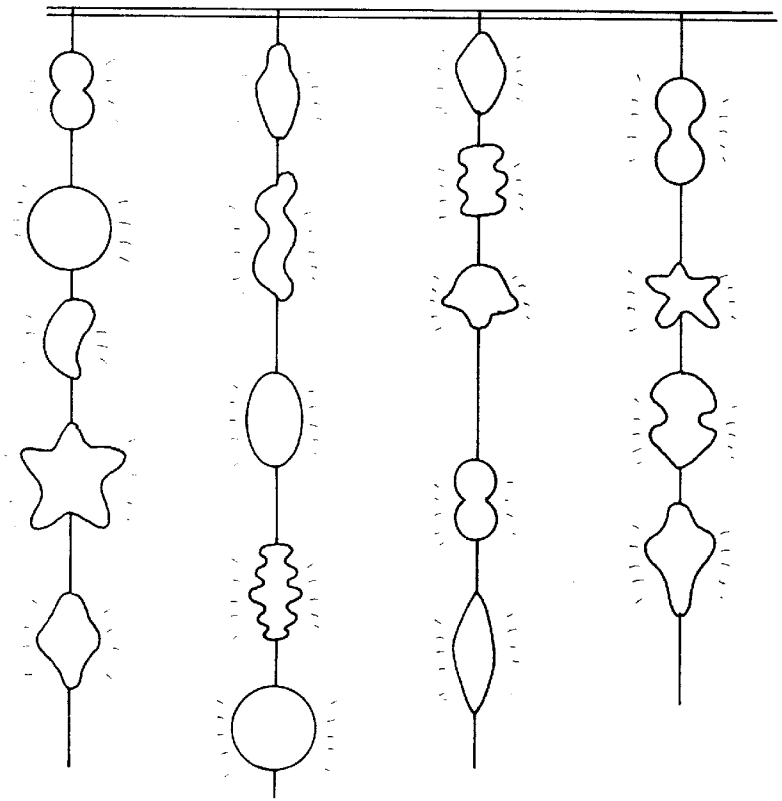
FIG. 11 is a view of a Christmas lamp of the present invention.
Figure 13:
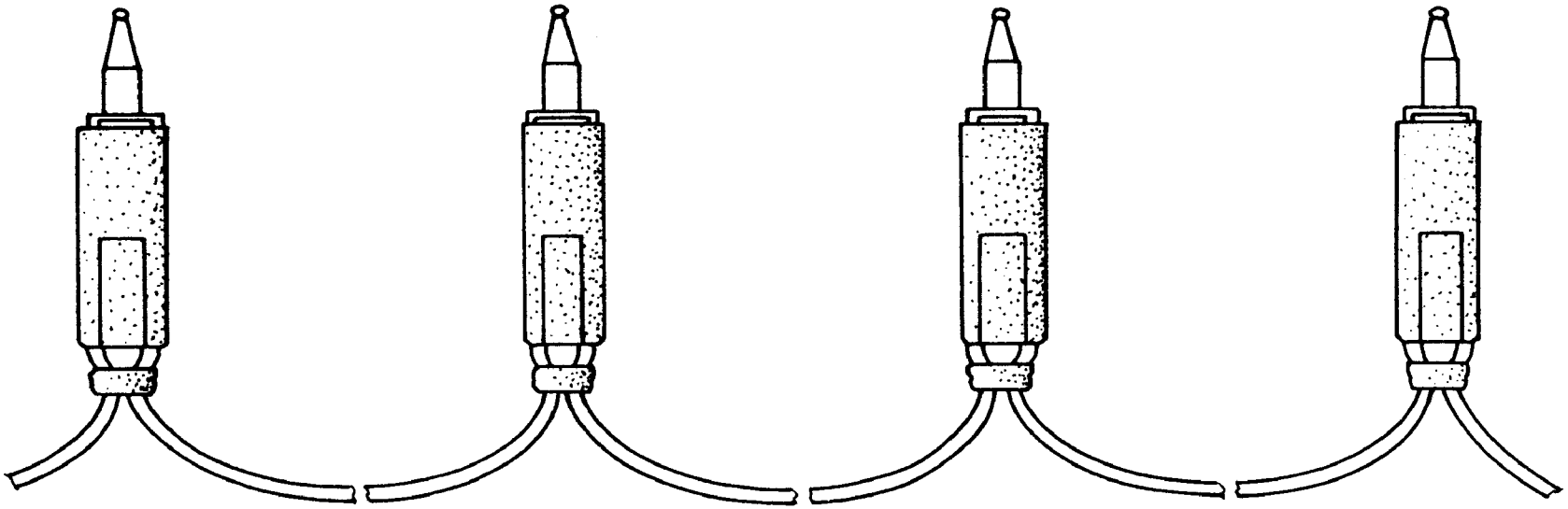
FIG. 13 (PRIOR ART)
FIG. 13 is a view of a conventional Christmas lamp.
Figure 14:
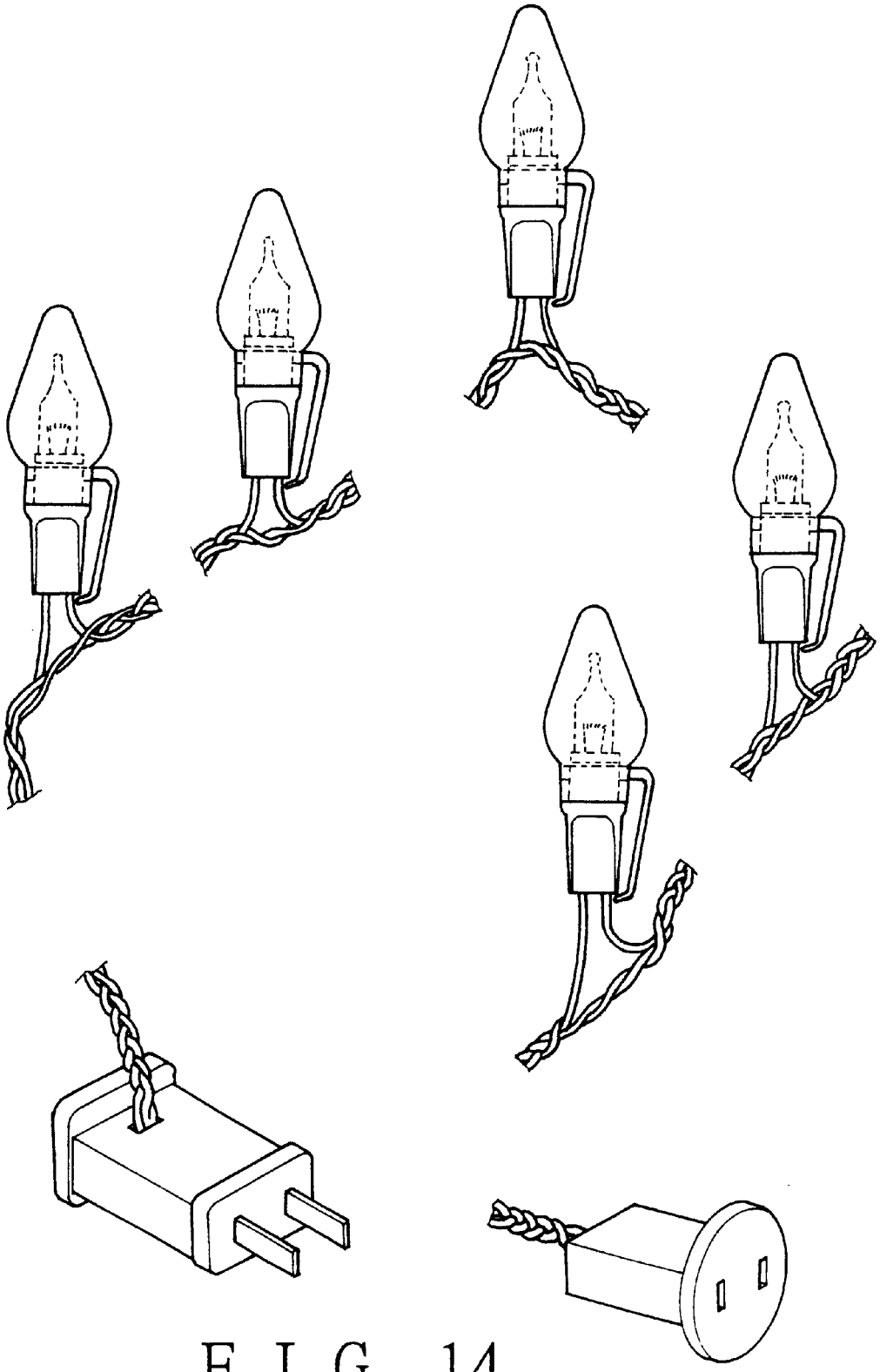
F I G. 14 (PRIOR ART)
FIG. 14 is a view of another conventional Christmas lamp.

Further referring to FIGS. 11 and 12, the lamp units of the present invention can be connected to a line or net of various shapes to form a complete Christmas lamps. The Christmas lamp can be used indoors as well as outdoors.

The ornamental shell parts can be made of transparent materials or semitransparent materials of various colors.

From the above description, the Christmas lamp of the present invention can be known to have desirable features as follows.

1. Because of the various shapes of the ornamental shell parts, the Christmas lamp looks more beautiful, and can inspire buying desire of the consumers.
2. The ornamental shell parts of the various shapes can be chosen according to needs to add to the festive air.

3. The ornamental shell part, being made of transparent, and semitransparent materials of various colors, can make the Christmas lamp units have their characteristics.

4. The ornamental shell parts can protect the bulbs from water or getting broken.

5. The ornamental shell part of various shapes can reflect light in various ways, making the Christmas lamps look attractive.

What is claimed is:

1. A Christmas lamp comprising a plurality of lamp units; said lamp units each having an ornamental shell part and a bulb; said ornamental shell parts of said lamp units having various shapes and colors; said bulbs being each received in a corresponding one of said ornamental shell parts with a lead passed through holes at two ends of said ornamental shell parts; said ornamental shell parts each has a first half part and a second half part, said first half part having an annular groove on an edge, said second half part having an annular protrusion on an edge; said first half part being connected to said second half part with said annular groove engaging said annular protrusion.

2. The Christmas lamp as claimed in claim 1, wherein said ornamental shell parts are made of transparent materials.

3. The Christmas lamp as claimed in claim 1, wherein said ornamental shell parts are made of semitransparent materials.

4. The Christmas lamp as claimed in claim 1, wherein said ornamental shell parts each has a main body and a cap member, said main body having a receiving hole for said cap member to be removably fitted thereto; said receiving hole being at least wider than said bulb for permitting said bulb to be passed therethrough.

* * * * *